US006195072B1

(12) United States Patent
Iwami et al.

(10) Patent No.: US 6,195,072 B1
(45) Date of Patent: Feb. 27, 2001

(54) PLASMA DISPLAY APPARATUS

(75) Inventors: Takashi Iwami; Mitsushi Kitagawa; Kenichiro Hosoi, all of Fukuroi (JP)

(73) Assignee: Pioneer Electronic Corporation, Tokyo (JP)

( * ) Notice: Subject to any disclaimer, the term of this patent is extended or adjusted under 35 U.S.C. 154(b) by 0 days.

(21) Appl. No.: 09/116,442

(22) Filed: Jul. 16, 1998

(30) Foreign Application Priority Data

Jul. 29, 1997 (JP) ..... 9-203553

(51) Int. Cl.[7] ..... G09G 3/28
(52) U.S. Cl. ..... 345/67; 345/68
(58) Field of Search ..... 345/60, 68, 67

(56) References Cited

U.S. PATENT DOCUMENTS 5,654,728 * 8/1997 Kanazawa et al. ..... 345/68
5,790,087 * 8/1998 Shigeta et al. ..... 345/67
5,854,540 * 12/1998 Matsumoto et al. ..... 315/169.1
5,889,502 * 3/1999 Iwama ..... 345/60
5,943,030 * 8/1999 Minamibayashi ..... 345/60
5,943,031 * 8/1999 Tokunaga et al. ..... 345/60
5,995,069 * 11/1999 Tokunaga et al. ..... 345/60
6,034,482 * 3/2000 Kanazawa et al. ..... 315/169.4

* cited by examiner

*Primary Examiner*—Richard A. Hjerpe
*Assistant Examiner*—Kevin M. Nguyen
(74) *Attorney, Agent, or Firm*—Morgan, Lewis & Bockius LLP

(57) ABSTRACT

A plasma display apparatus capable of easily implementing stable image display. In generating a priming pulse and a scan pulse by alternately applying the potentials of the positive terminal and negative terminal of a first voltage supply for generating a DC voltage, to row electrodes, the potential of the positive terminal of a second voltage supply with a grounded negative terminal for generating a DC voltage smaller than a voltage of the first voltage supply is applied to the positive terminal of the first voltage supply, thereby shifting the potential of the negative terminal of the first voltage supply on a negative side.

6 Claims, 7 Drawing Sheets

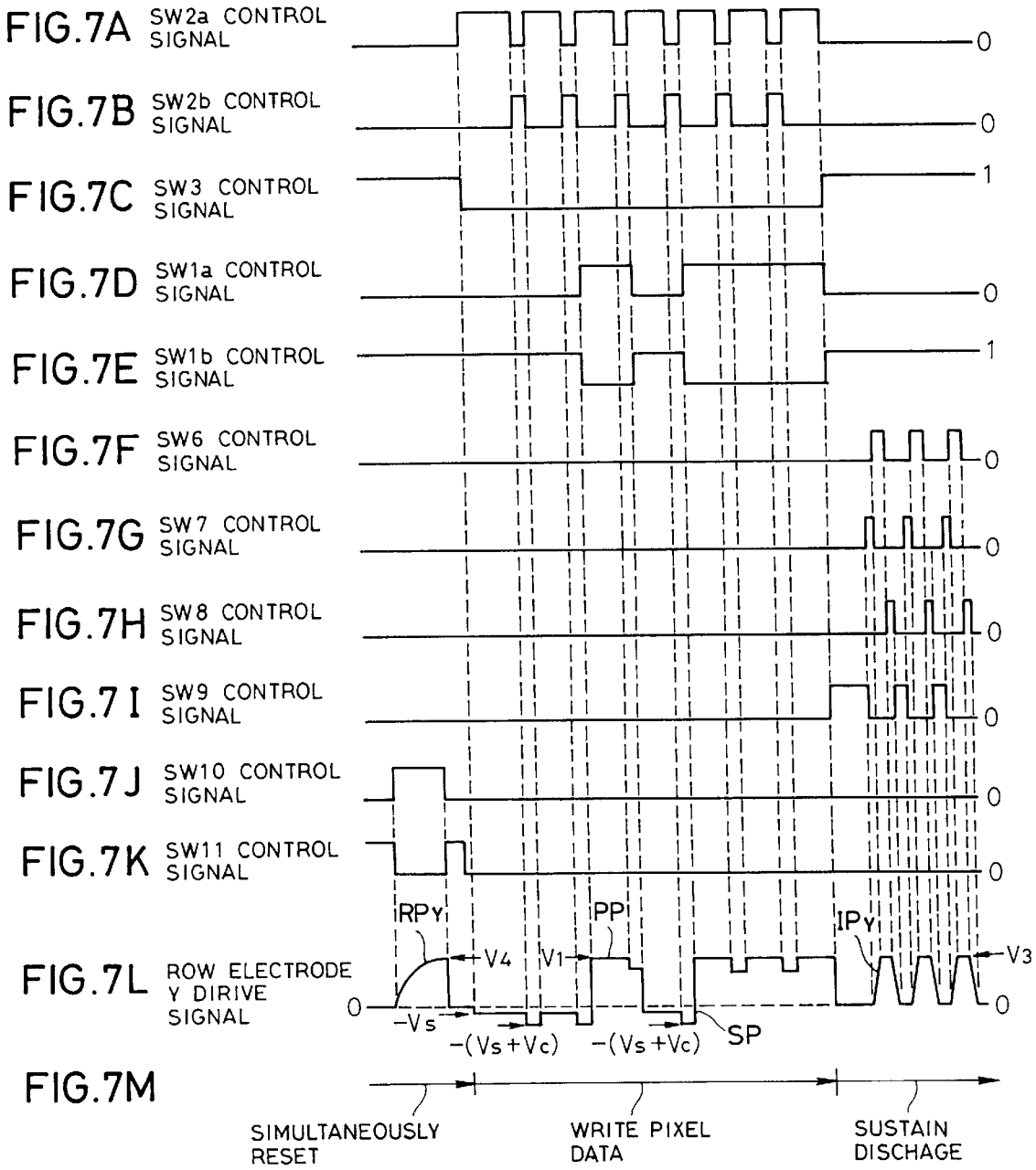
FIG.7A SW2a CONTROL SIGNAL
FIG.7B SW2b CONTROL SIGNAL
FIG.7C SW3 CONTROL SIGNAL
FIG.7D SW1a CONTROL SIGNAL
FIG.7E SW1b CONTROL SIGNAL
FIG.7F SW6 CONTROL SIGNAL
FIG.7G SW7 CONTROL SIGNAL
FIG.7H SW8 CONTROL SIGNAL
FIG.7I SW9 CONTROL SIGNAL
FIG.7J SW10 CONTROL SIGNAL
FIG.7K SW11 CONTROL SIGNAL
FIG.7L ROW ELECTRODE Y DIRIVE SIGNAL
FIG.7M
0
1
RPY
V4
V1
PP
IPY
V3
-Vs
-(Vs+Vc)
-(Vs+Vc)
SP
SIMULTANEOUSLY RESET
WRITE PIXEL DATA
SUSTAIN DISCHAGE

PLASMA DISPLAY APPARATUS

BACKGROUND OF THE INVENTION

1. Field of the Invention

The present invention relates to a plasma display apparatus.

2. Description of Related Art

As a plasma display panel (hereinafter referred to as PDP) that is one of flat display apparatuses, there is known an AC (Alternate Current discharge) type PDP.

In cases where a scan pulse of a negative voltage as well as a priming pulse of a positive voltage are applied to an AC type PDP, it is difficult to drive a PDP which uses a row electrode drive signal having three level states by using a general-purpose IC because such an IC can perform scanning only with pulses of a single polarity for one channel.

OBJECT AND SUMMARY OF THE INVENTION

Accordingly, it is contemplated by the present invention to solve the problem mentioned above, and it is an object of this invention to provide a plasma display apparatus capable of easily implementing stable image display with low power dissipation.

A plasma display apparatus according to this invention comprises a plasma display panel having a plurality of row electrodes and a plurality of column electrodes laid out to intersect the row electrodes; and a row electrode driving device for applying a priming pulse to the row electrodes to temporarily discharge discharge cells formed at intersections of the row electrodes and the column electrodes, and then applying a scan pulse to the row electrodes to thereby write pixel data, the row electrode driving device including a first voltage supply for generating a DC voltage, a scan pulse generator for alternately applying a potential of a positive terminal of the first voltage supply and a potential of a negative terminal thereof to the row electrodes to generate the priming pulse and the scan pulse, and a voltage-supply potential shifter which includes a second voltage supply with a grounded negative terminal, said second voltage supply generating a DC voltage smaller than a voltage of the first voltage supply, for applying a potential of a positive terminal of said second voltage supply to the positive terminal of the first voltage supply, thereby shifting the potential of the negative terminal of the first voltage supply.

BRIEF DESCRIPTION OF THE DRAWINGS

FIGS. 7A through 7M are diagrams showing the correlation between individual SW control signals and the row electrode Y drive signal.

DETAILED DESCRIPTION OF THE PREFERRED EMBODIMENT

Before entering into a detailed description of a preferred embodiment of the present invention, one example of the conventional plasma display apparatus will be explained with reference to the accompanying drawings.

Figure 1:
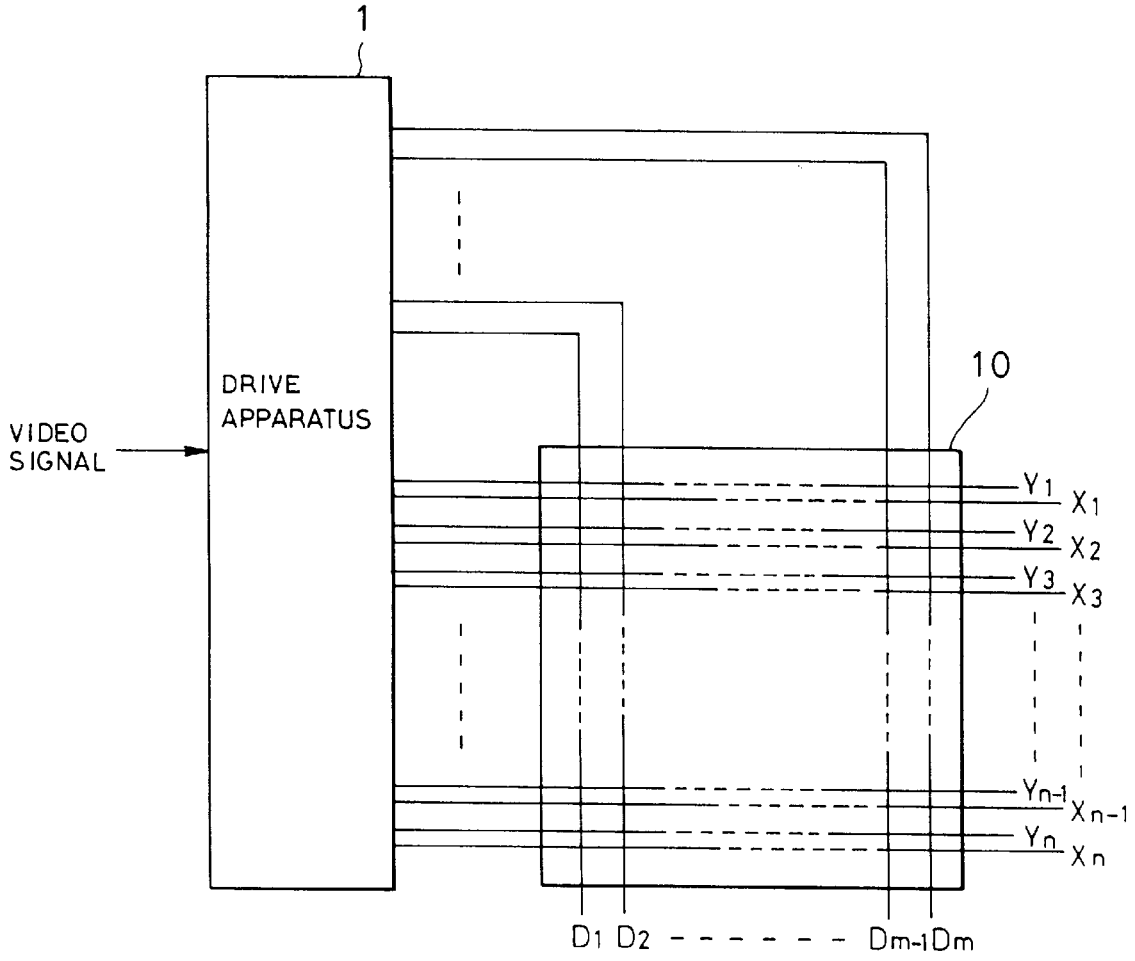
FIG. 1 is a diagram illustrating the schematic constitution of a plasma display apparatus.

FIG. 1 illustrates the schematic constitution of the plasma display apparatus which includes a drive apparatus for driving an AC type PDP.

In FIG. 1, formed in a PDP 10 are pairs of row electrodes $Y_1$–$Y_n$ and row electrodes $X_1$–$X_n$, each pair corresponding to an associated one of the individual rows (first to n-th rows) of one screen. Further, column electrodes $D_1$–$D_m$ corresponding to the individual columns (first to m-th columns) of one screen are formed perpendicular to those pairs of row electrodes and sandwiched between an unillustrated dielectric layer and discharge space. One discharge cell is formed at the intersection of one pair of row electrodes (X, Y) and one column electrode D.

A drive apparatus 1 converts a supplied video signal to pixel data of N bits, converts the pixel data to m pixel data pulses for each row of the PDP 10, and then applies the pixel data pulses to the column electrodes $D_1$–$D_m$ of the PDP 10.

The drive apparatus 1 further generates row electrode drive signals including a reset pulse $RP_x$, a reset pulse $RP_y$, a priming pulse PP, a scan pulse SP, a sustain pulse $IP_x$, a sustain pulse $IP_y$ and an erase pulse EP according to the timing, as shown in FIGS. 2A through 2F, and applies those drive signals to the pairs of row electrodes ($Y_1$–$Y_n$, $X_1$–$X_n$) of the PDP 10.

In FIGS. 2A–2F, first, the drive apparatus 1 generates the reset pulse $RP_y$ of a negative voltage, and applies the reset pulse $RP_y$ to all the row electrodes $Y_1$–$Y_n$ at the same time as generating the reset pulse $RP_x$ of a positive voltage, and applying the reset pulse $RP_x$ to all the row electrodes $X_1$–$X_n$ (simultaneous resetting step).

The application of the reset pulses causes electric discharge pumping of all the discharge cells of the PDP 10, generating charge particles, and after the discharging is completed, a predetermined amount of wall charges are uniformly formed in the dielectric layer of the entire discharge cells.

Figures 2A, 2B, 2C, 2D, 2E, 2F:
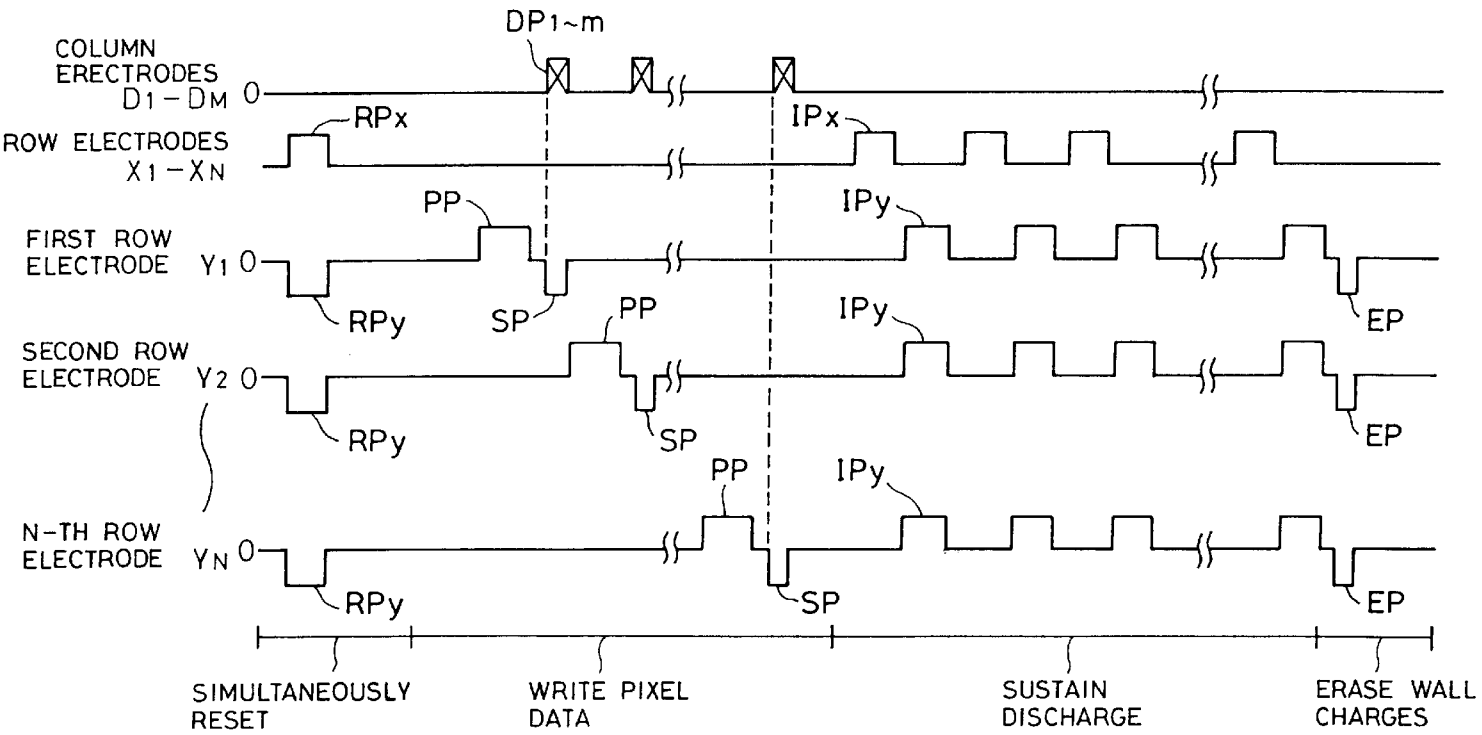
FIGS. 2A through 2F are timing charts for row electrode drive signals of a drive apparatus in FIG. 1.

Then, the drive apparatus 1 generates pixel data pulses $DP_1$–$DP_m$ of a positive voltage corresponding to individual rows of pixel data supplied from a memory 13, and applies those pulses to the column electrodes $D_1$–$D_m$ row by row. Further, the drive apparatus 1 generates the scan pulse SP of a negative voltage and a relatively smaller pulse width at the same timing as the timing for applying the pixel data pulses $DP_1$–$DP_m$ to the column electrodes $D_1$–$D_m$, and sequentially applies to the row electrodes from $Y_1$ to $Y_n$ as shown in FIGS. 2C to 2E. Of the discharge cells present at the row electrode to which the scan pulse SP has been applied, any discharge cell to which a high-voltage pixel data pulse has been applied causes discharging, so that most of the wall charges are lost. Meanwhile, those discharge cells to which no pixel data pulses have been applied do not cause discharging, so that the wall charges remain. That is, whether or not wall charges remain in each discharge cell is determined in accordance with the pixel data pulse applied to an associated column electrode. This means that pixel data has been written in each discharge cell in accordance with the application of the scan pulse SP. The drive apparatus 1 applies the priming pulse PP of a positive voltage as shown in FIGS. 2C to 2E to the row electrodes $Y_1$–$Y_n$, before applying the scan pulse SP of the negative voltage to each row electrode Y (pixel data writing step).

The application of the priming pulse PP permits reformation of the charge particles, which have been acquired in the aforementioned simultaneously resetting operation and have been reduced with passage of the time, in the discharge space of the PDP 10. While those charge particles are present, writing of pixel data by the application of the scan pulse SP is to be carried out.

Next, the drive apparatus 1 applies the sustain pulse $IP_y$ of a positive voltage to the row electrodes $Y_1$–$Y_n$, and consecutively applies the sustain pulse $IP_x$ of a positive voltage to the row electrodes $X_1$–$X_n$ at a timing different from the application timing of the sustain pulse $IP_y$ (sustain discharge step).

Over a period where the sustain pulses $IP_x$ and $IP_y$ are alternately applied, the discharge cells which have the wall charges remaining repeat discharge light emission to maintain the light-emission state.

Then, the drive apparatus 1 generates the erase pulse EP of a negative voltage and simultaneously applies the pulse EP to the row electrodes $Y_1$–$Y_n$ to erase the wall charges remaining in the individual discharge cells (wall charge erasing step).

As apparent from the above, this plasma display apparatus applies the priming pulse PP of a positive voltage immediately before applying the scan pulse SP of a negative voltage, thus ensuring a constant amount of charge particles in the discharge space, row by row, immediately prior to the application of the scan pulse SP.

Accordingly, the conditions in the individual discharge spaces of the first row to the n-th row can be made uniform entirely at the time of writing pixel data, so that stable image display is implemented.

At this time, however, the drive apparatus 1 must generate the priming pulse PP of a positive voltage as well as the scan pulse SP of a negative voltage and apply those pulses to the first row electrode to the n-th row electrode of the PDP 10 while scanning. That is, the drive apparatus 1 should generate a row electrode drive signal having three level states (0 V, the negative voltage of the scan pulse SP and the positive voltage of the priming pulse PP) as shown in FIGS. 2A–2F.

Since a general-purpose IC can perform scanning only with a pulse of a single polarity, as mentioned earlier, however, the drive method as illustrated in FIGS. 2A–2F has a difficulty in driving a PDP using the general-purpose IC.

One embodiment of the invention will now be described with reference to the accompanying drawings.

Figure 3:
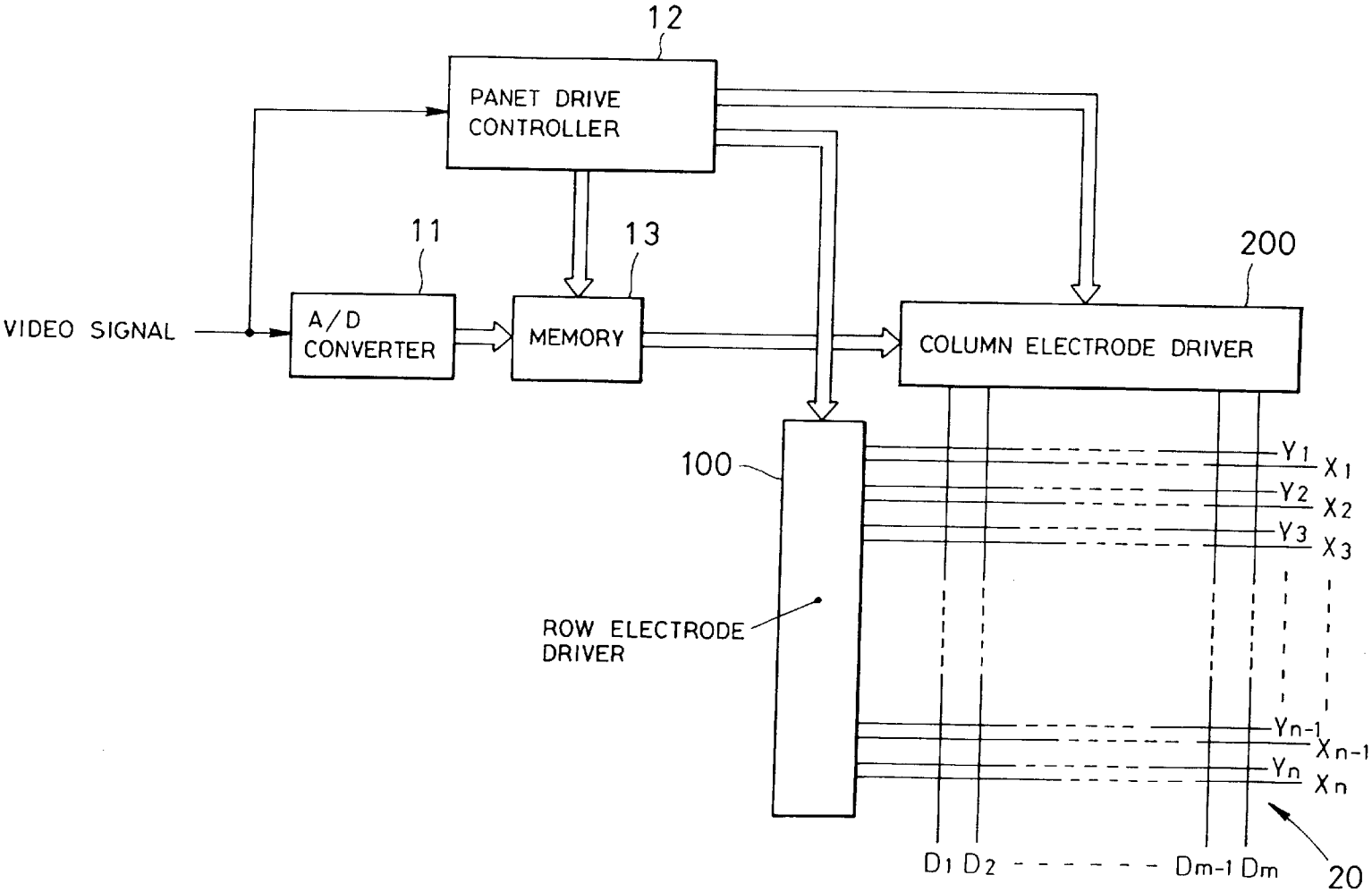
FIG. 3 is a diagram illustrating the schematic constitution of a plasma display apparatus according to this invention.
Figures 4A, 4B, 4C, 4D, 4E, 4F, 4G:
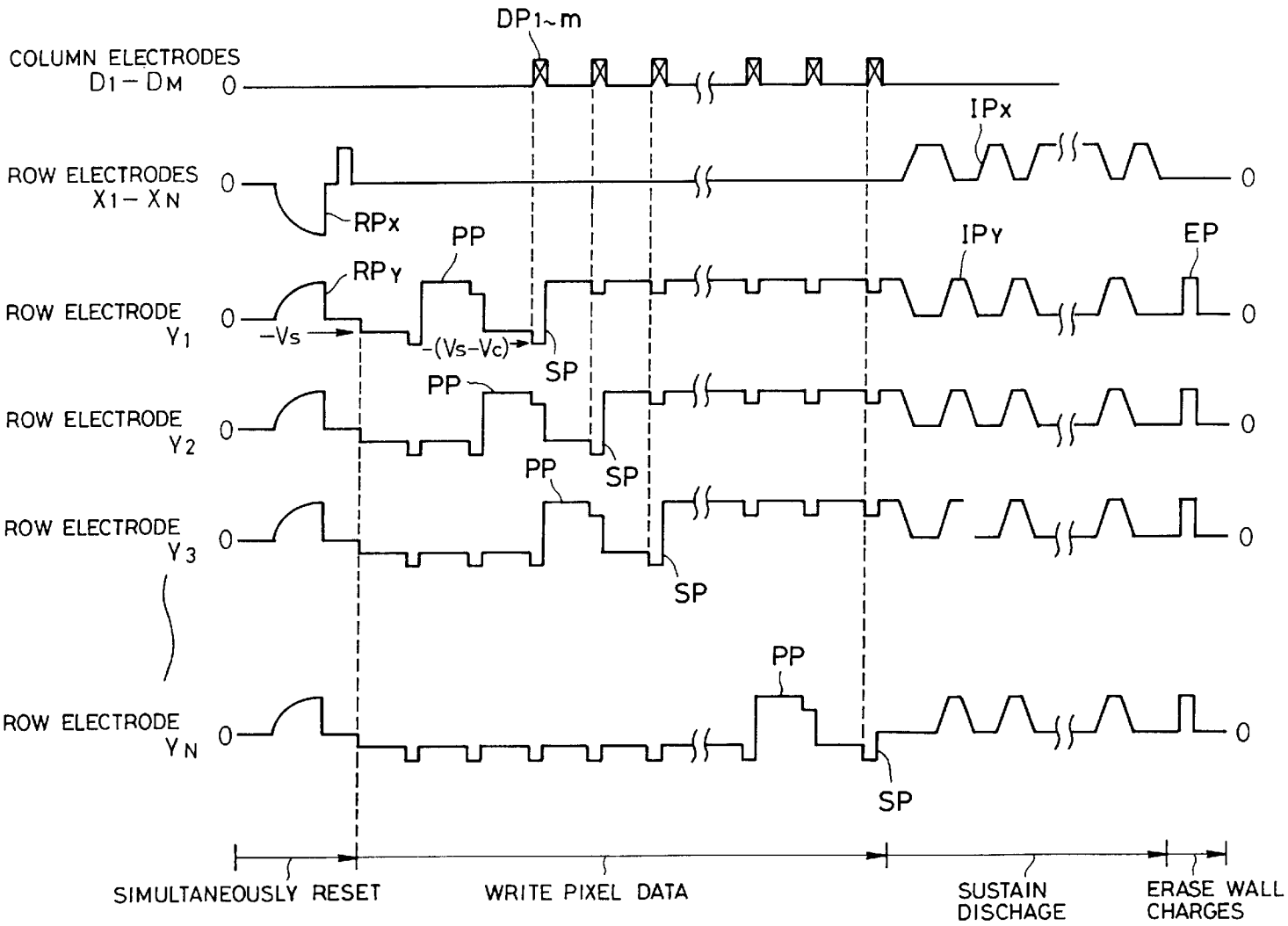
FIGS. 4A through 4G are timing charts for row electrode drive signals of a drive apparatus of this invention.

FIG. 3 is a diagram illustrating the general constitution of a plasma display apparatus according to this invention.

In FIG. 3, an A/D converter 11 samples a supplied analog video signal to covert it to pixel data of N bits, pixel by pixel, and supplies the pixel data to a memory 13. A panel drive controller 12 detects a horizontal sync signal and a vertical sync signal in the video signal, generates various kinds of signals, which will be discussed later, based on the detection timing, and supplies those signals to the memory 13, a row electrode driver 100 and a column electrode driver 200.

The memory 13 sequentially stores the pixel data in accordance with a write signal supplied from the panel drive controller 12. Further, the pixel data written in the above manner is read from the memory 13, row by row of a PDP (Plasma Display Panel) 20 and is supplied to the column electrode driver 200, in accordance with a read signal supplied from the panel drive controller 12.

Formed in the PDP 20 are pairs of row electrodes $Y_1$–$Y_n$ and row electrodes $X_1$–$X_n$, each pair corresponding to an associated one of the individual rows (first to n-th rows) of one screen. Further, column electrodes $D_1$–$D_m$ corresponding to the individual columns (first to m-th columns) of one screen are formed perpendicular to those pairs of row electrodes and sandwiched between an unillustrated dielectric layer and discharge space. One discharge cell is formed at the intersection of one pair of row electrodes (X, Y) and one column electrode D.

The column electrode driver 200 generates pixel data pulses corresponding to one row of pixel data supplied from the memory 13, and applies the pulses to the column electrodes $D_1$–$D_m$ of the PDP 20 in accordance with a pixel-data-pulse application timing signal supplied from the panel drive controller 12.

The row electrode driver 100 generates the row electrode X drive signals including the reset pulse $RP_x$ and the sustain pulse $IP_x$, as shown in FIGS. 4A–4G, to the row electrodes $X_1$–$X_n$, of the PDP 20 respectively, in accordance with various timing signals supplied from the panel drive controller 12.

The row electrode driver 100 generates the row electrode X drive signals including the reset pulse $RP_y$, the priming pulse PP, the scan pulse SP, the sustain pulse $IP_y$ and the erase pulse EP, as shown in FIGS. 4A–4G, to the row electrodes $Y_1$–$Y_n$ of the PDP 20 respectively.

In FIGS. 4A–4G, first, the row electrode driver 100 applies the row electrode Y drive signals $Y_1$–$Y_n$, having the reset pulse $RP_y$ of a positive voltage to the row electrodes $Y_1$–$Y_n$, at the same time as applying the row electrode X drive signals $X_1$–$X_n$ having the reset pulse $RP_x$ of a negative voltage to all the row electrodes $X_1$–$X_n$. After the application of the reset pulse $RP_y$, the row electrode driver 100 sets the voltage levels of the row electrode Y drive signals $Y_1$–$Y_n$ to be applied to the row electrodes $Y_1$–$Y_n$ back to 0 V (simultaneously resetting step).

The simultaneous application of the reset pulses $RP_x$ and $RP_y$ causes all the discharge cells of the PDP 20 to be discharged, generating charge particles in the discharge space. After the discharging is completed, a predetermined amount of wall charges are uniformly formed in the dielectric layer of the entire discharge cells.

Next, the row electrode driver 100 sets the voltage levels of the row electrode Y drive signals $Y_1$–$Y_n$ to be applied to the respective row electrodes $Y_1$–$Y_n$ the negative voltage minus $V_S$ as shown in FIGS. 4C–4F. Then, the column electrode driver 200 sequentially applies the pixel data pulses $DP_1$–$DP_m$ of a positive voltage corresponding to the individual rows of pixel data to the column electrodes $D_1$–$D_m$, row by row. The row electrode driver 100 generates the row electrode Y drive signals $Y_1$–$Y_n$, having the priming pulse PP of a positive voltage immediately before the application of the pixel data pulses $DP_1$–$DP_m$ to the column electrodes $D_1$–$D_m$, and sequentially applies the row electrode Y drive signals $Y_1$–$Y_n$ to the respective row electrodes $Y_1$–$Y_n$. After applying the priming pulse PP, the row electrode driver 100 temporarily sets the voltage levels of the row electrode Y drive signals $Y_1$–$Y_n$ back to the negative voltage minus $V_S$. When application of the pixel data pulses $DP_1$–$DP_m$ by the column electrode driver 200 is finished, the row electrode driver 100 sequentially switches the voltage levels of the row electrode Y drive signals $Y_1$–$Y_n$ to positive voltages (pixel data writing step).

Figures 5A, 5B, 5C:
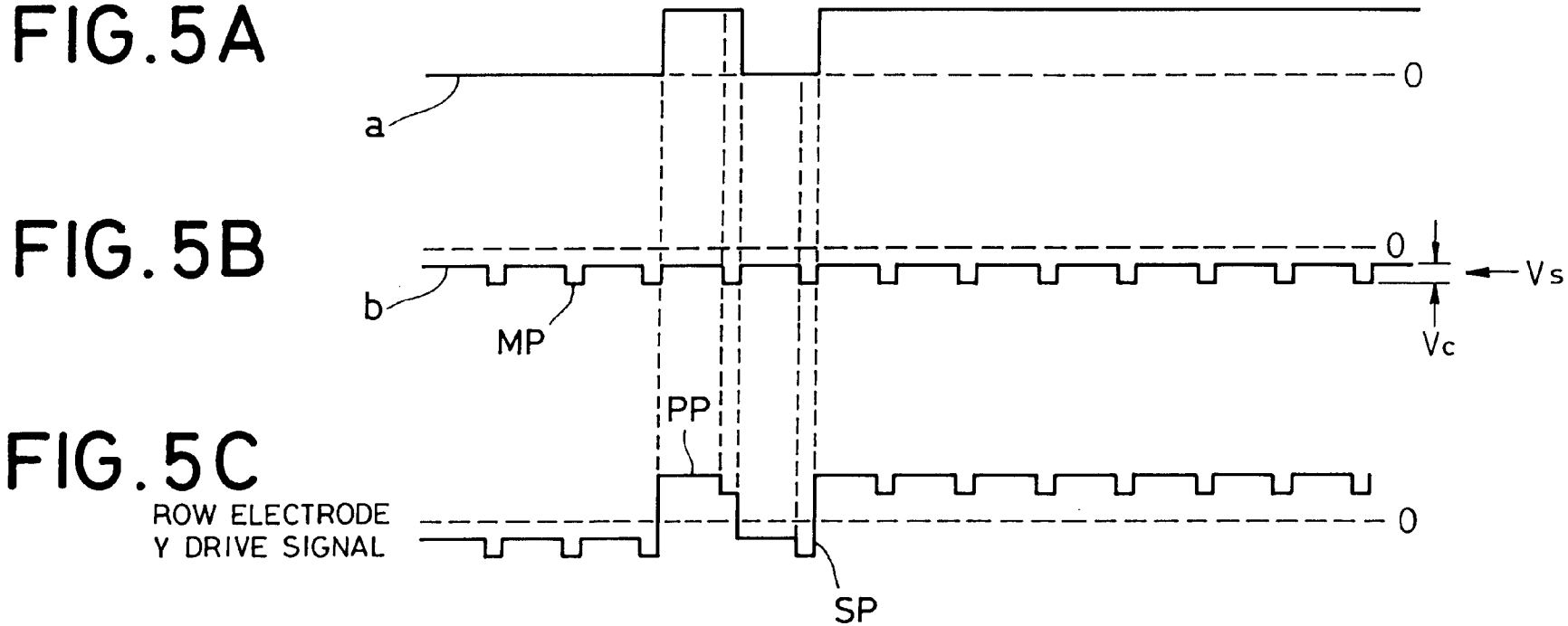
FIGS. 5A through 5C are diagrams showing level shifting of a row electrode Y drive signal.

In the pixel data writing step, the row electrode driver 100 performs level shifting, as indicated by a level shift signal b, on a reference drive signal a as shown in FIG. 5A, generating the row electrode Y drive signals $Y_1$–$Y_n$ as shown in FIGS. 4C–4F. At this time, pulses MP in the level shift signal b have the same pulse period and same pulse width as the application period and pulse width of the pixel data pulses D. The pulses MP in the level shift signal b has an amplitude level of $V_C$ indicating that the level shift signal b itself is offset by the negative voltage minus $V_S$.

When the row electrode Y drive signal has a voltage level of the negative voltage minus $V_S$ at the end of each priming pulse PP in the pixel data writing step, the scan pulse SP is the portion whose voltage level is dropped to $-(V_S+V_C)$ by the pulse MP. Wall charges according to the pulse voltage values of the pixel data pulses $DP_1$–$DP_m$ remain in the individual discharge cells belonging to the row electrode to which this scan pulse SP has been applied. That is, pixel data is written in one row of discharge cells.

As the scan pulse SP is applied to the entire row electrodes $Y_1$–$Y_n$ and writing of pixel data to the entire rows is completed, the row electrode driver 100 stops level-shifting the row electrode Y drive signals. Here, the row electrode driver 100 applies the row electrode Y drive signals $Y_1$–$Y_n$ which have a sequence of sustain pulses $IP_y$ of a negative voltage to the row electrodes $Y_1$–$Y_n$ respectively. Further, the row electrode driver 100 applies the row electrode X drive signals $X_1$–$X_n$, which have a sequence of sustain pulses $IP_x$ of a positive voltage, at a timing different from the application timing of the sustain pulse $IP_y$, to the row electrodes $X_1$–$X_n$, respectively (sustain discharge step).

Over a period where the sustain pulses $IP_x$ and $IP_y$ are alternately applied, only the discharge cells which have the wall charges remaining even after the pixel data writing step has been completed repeat discharge light emission to maintain the light-emission state.

Then, the row electrode driver 100 simultaneously applies the row electrode Y drive signals $Y_1$–$Y_n$, which include the erase pulse EP of a positive voltage and having a relatively small pulse width, to the row electrodes $Y_1$14 $Y_n$ to erase the wall charges remaining in the individual discharge cells of the PDP 20 (wall charge erasing step).

Figure 6:
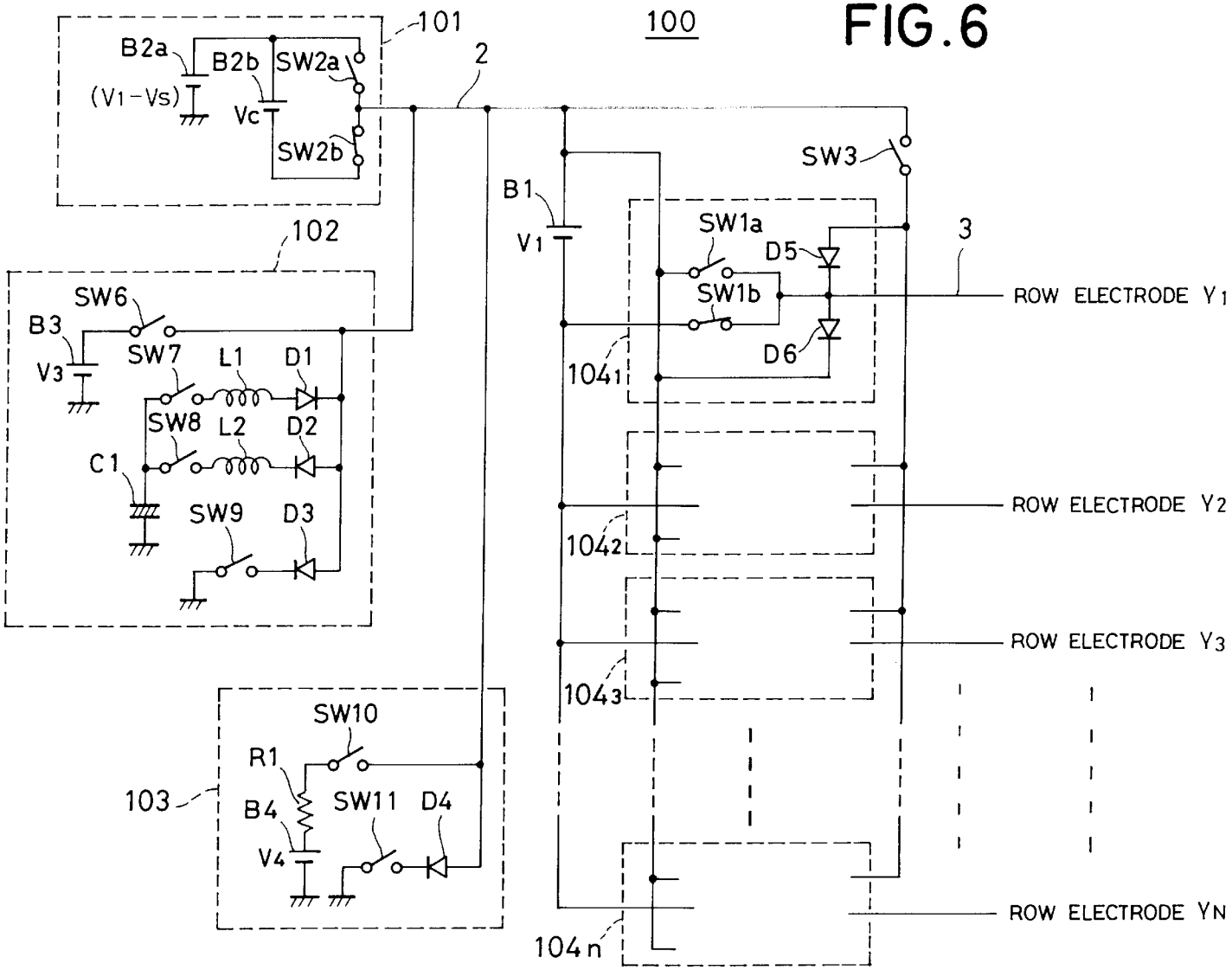
FIG. 6 is a diagram depicting the internal constitution of a row electrode driver 100.

FIG. 6 is a diagram depicting part of the internal constitution of the row electrode driver 100, which generates the aforementioned row electrode Y drive signals $Y_1$–$Y_n$.

As shown in FIG. 6, the row electrode driver 100 comprises a voltage-supply potential shifter 101, a sustain pulse generator 102, a reset pulse generator 103, and scan pulse generators $\mathbf{104}_1$ to $\mathbf{104}_n$.

The voltage-supply potential shifter 101 is provided with a second voltage supply B2*a*, which generates a DC voltage lower by a predetermined $V_S$ than a DC voltage $V_1$ of a first voltage supply B1 (to be discussed later) and has a negative terminal grounded, and a second voltage supply B2*b*, which has a positive terminal connected to the positive terminal of the second voltage supply B2*a* and generates a DC voltage $V_C$. A switching element SW2*a* in the voltage-supply potential shifter 101 performs an ON/OFF action according to the logic level of an SW2*a* control signal supplied from the panel drive controller 12, and applies the potential of the positive terminal of the second voltage supply B2*a* (or the positive terminal of the second voltage supply B2*b*) onto a line 2 when set on. A switching element SW2*b* in the voltage-supply potential shifter 101 performs an ON/OFF action according to the logic level of an SW2*b* control signal supplied from the panel drive controller 12, and applies the potential of the negative terminal of the second voltage supply B2*b* onto the line 2 when set on.

A switching element SW6 in the sustain pulse generator 102 performs an ON/OFF action according to the logic level of an SW6 control signal supplied from the panel drive controller 12, and applies the potential of the positive terminal of a third voltage supply B3 onto the line 2 when set on. The third voltage supply B3, which generates a DC voltage $V_3$, has its negative terminal grounded. Further, the sustain pulse generator 102 has a capacitor C1 whose one end is grounded. A switching element SW7 performs an ON/OFF action according to the logic level of an SW7 control signal supplied from the panel drive controller 12, and applies the potential, which has been generated on the opposite end of the capacitor C1, to the anode end of a diode D1 via a coil L1, when set on. A switching element SW8 performs an ON/OFF action according to the logic level of an SW8 control signal supplied from the panel drive controller 12, and applies the potential, generated on the opposite end of the capacitor C1, to the cathode end of a diode D2 via a coil L2, when set on. A switching element SW9 performs an ON/OFF action according to the logic level of an SW9 control signal supplied from the panel drive controller 12, and applies the ground potential to the cathode end of a diode D3 when set on. The anode end of the diode D3, the cathode end of the diode D1 and the anode end of the diode D2 are connected together to the line 2.

A switching element SW10 in the reset pulse generator 103 performs an ON/OFF action according to the logic level of an SW10 control signal supplied from the panel drive controller 12, and applies the potential of the positive terminal of a fourth voltage supply B4 via a resistor R1 onto the line 2 when set on. The fourth voltage supply B4, which generates a DC voltage $V_4$, has its negative terminal grounded. A switching element SW11 in the reset pulse generator 103 performs an ON/OFF action according to the logic level of an SW11 control signal supplied from the panel drive controller 12, and applies the ground potential to the cathode end of a diode D4 when set on. The anode end of the diode D4 is connected to the line 2.

The scan pulse generators $\mathbf{104}_1$–$\mathbf{104}_n$ have the same circuit constitution and receive power from the first voltage supply B1, which generates the aforementioned DC voltage $V_1$, and has its positive terminal connected to the line 20.

A switching element SW1a in each scan pulse generator 104 performs an ON/OFF action according to the logic level of an SW1a control signal supplied from the panel drive controller 12, and applies the potential on the line 2 to a row electrode drive line 3, when set on. At this time, the potential applied onto the row electrode drive line 3 becomes the aforementioned row electrode Y drive signal to be applied to the row electrode Y of the PDP 20. A switching element SW1*b* in each scan pulse generator 104 performs an ON/OFF action according to the logic level of an SW1*b* control signal supplied from the panel drive controller 12, and applies the potential of the negative terminal of the first voltage supply B1 to the row electrode drive line 3, when set on. Each scan pulse generator 104 is provided with a diode D5, which applies the potential of the line 2 to the row electrode drive line 3 when a switching element SW3 is set on, and a diode D6 which has an anode end connected to the row electrode drive line 3 and a cathode end connected to the line 2.

Each of the switching elements is actually a semiconductor switch comprised of an MOS (Metal Oxide Semiconductor) transistor or the like.

A description will now be given of the internal operation of the row electrode driver 100 which has the constitution as illustrated in FIG. 6.

FIGS. 7A through 7M are diagrams exemplifying the timings of supplying the individual SW control signals from the panel drive controller 12 in the simultaneous resetting step, the pixel data writing step and the sustain discharge step, and the row electrode Y drive signals which are generated by those SW control signals.

It is assumed that in the embodiment illustrated in FIGS. 7A–7M, each switching element becomes off when the associated SW control signal has a logic level of "0", and becomes on when the associated SW control signal has a logic level of "1".

Simultaneous Resetting Step

First, the panel drive controller 12 sets the logic levels of only the SW3, SW1*b* and SW11 control signals to "1" and sets the logic levels of the other control signals to "0".

Consequently, the switching elements SW3, SW1*b* and SW11 in FIG. 6 become on, setting the levels of the row electrode Y drive signals to "0" (V) as shown in FIG. 7L.

Next, the panel drive controller 12 switches the logic level of the SW10 control signal to "1" and the logic level of the SW11 control signal to "0".

As a result, the switching element SW10 in the reset pulse generator 103 in FIG. 6 becomes on, so that the potential of the positive terminal of the fourth voltage supply B4 is applied to the row electrode drive line 3 via the resistor R1, the switching element SW10, the line 2, the switching element SW3 and the diode D5. At this time, the signal level of the row electrode Y drive signal on the row electrode drive line 3 gradually rises from "0" (V) and reaches the supply voltage $V_4$ of the fourth voltage supply B4 due to the action of the resistor R1.

Then, the panel drive controller 12 switches the logic level of the SW10 control signal to "0" and the logic level of the SW11 control signal to "1".

As a result, the switching element SW11 in the reset pulse generator 103 in FIG. 6 becomes on, so that the signal level of the row electrode Y drive signal on the row electrode drive line 3 becomes "0" (V) as shown in FIG. 7L. At this time, the pulse of a positive voltage acquired by the operation of the reset pulse generator 103 becomes the reset pulse $RP_y$.

Then, the panel drive controller 12 switches the logic level of the SW11 control signal to "0" to set the switching element SW11 in the reset pulse generator 103 off.

This operation renders the line 2 floating or applied with no voltage.

Pixel Data Writing Step

With the line 2 floating, the panel drive controller 12 switches the logic level of the SW2*a* control signal to "1" and the logic level of the SW3 control signal to "0".

As a result, the potential on the line 2 becomes $-V_S$ which is applied to the row electrode drive line 3 and is led out as the row electrode Y drive signal of a negative voltage.

In switching the level of the row electrode Y drive signal to a negative voltage, the line 2 is set floating so that an excessive level change to the negative voltage side does not happen in the row electrode Y drive signal. In other words, this constitution prevents the flow of a wasteful current which would otherwise occur due to such an excessive level change, thereby suppressing power dissipation.

Thereafter, the logic levels of the SW2*a* control signal and the SW2*b* control signal are alternately switched from "1" to "0" and from "0" to "1" respectively, and this alternate switching is repeated, as shown in FIGS. 7A–7B.

Accordingly, the switching elements SW2*a* and SW2*b* in the voltage-supply potential shifter 101 in FIG. 6 alternately perform the ON/OFF action, thereby implementing level-shifting of the potential on the line 2 as shown in FIG. 5B.

Specifically, when the logic level of the SW2*a* control signal is"1" and the logic level of the SW2*b* control signal is"0", the switching element SW2*a* in the voltage-supply potential shifter 101 becomes on and the switching element SW2*b* becomes off, so that the level of the row electrode Y drive signal on the row electrode drive line 3 becomes the negative voltage minus $V_S$.

When the logic level of the SW2*a* control signal is "0" and the logic level of the SW2*b* control signal is "1", on the other hand, the switching element SW2*a* in the voltage-supply potential shifter 101 becomes off and the switching element SW2*b* becomes on, so that the level of the row electrode Y drive signal on the row electrode drive line 3 becomes the negative voltage minus $(V_S+V_C)$.

Next, the panel drive controller 12 switches the logic level of the SW1*a* control signal to "1" and the logic level of the SW1*b* control signal to "0".

As a result, the switching element SW1*a* in the scan pulse generator 104 becomes on, and the switching element SW1*b* becomes off, so that the row electrode Y drive signal on the row electrode drive line 3 will have a level of a positive voltage equal to the supply voltage $V_1$ of the second voltage supply B2*a*, as shown in FIG. 7L.

Then, the panel drive controller 12 switches the logic level of the SW1*a* control signal to "0" and the logic level of the SW1*b* control signal to "1".

Consequently, the row electrode Y drive signal on the row electrode drive line 3 becomes a negative voltage of the same form as the level shift signal b in FIG. 5B. The pulse of a positive voltage obtained at this time becomes the priming pulse PP.

When the logic level of the SW2*a* control signal is "1" and the logic level of the SW2*b* control signal is "0", the switching element SW2*a* in the voltage-supply potential shifter 101 becomes on and the switching element SW2*b* becomes off, so that the level of the row electrode Y drive signal on the row electrode drive line 3 becomes the negative voltage minus $V_S$.

When the logic level of the SW2*a* control signal is "0" and the logic level of the SW2*b* control signal is "1", on the other hand, the switching element SW2*a* in the voltage-supply potential shifter 101 becomes off and the switching element SW2*b* becomes on, so that the level of the row electrode Y drive signal on the row electrode drive line 3 becomes the negative voltage minus $(V_S+V_C)$.

At this time, the portion of the row electrode Y drive signal whose level has become the negative voltage minus $(V_S+V_C)$ after the priming pulse PP becomes the scan pulse SP, as shown in FIG. 7L.

After generating the scan pulse SP, the panel drive controller 12 switches the logic level of the SW1*a* control signal to "1" and the logic level of the SW1*b* control signal to "0".

As a result, as shown in FIG. 7L, the row electrode Y drive signal on the row electrode drive line 3 becomes a positive-voltage signal level-shifted by the level shift signal b in FIG. 5B.

Sustain Discharge Step

Next, the panel drive controller 12 switches the logic levels of the SW2*a* control signal, the SW2*b* control signal, the SW3 control signal, the SW1*a* control signal and the SW1*b* control signal to "0", "0", "1", "1" and "1", respectively, and further switches the logic levels of the SW6 control signal, the SW7 control signal, the SW8 control signal and SW9 control signal from "0" to "1" and from "1" to "0" as shown in FIGS. 7F to 7I, and repeats this switching operation.

When the logic level of the SW3 control signal becomes "1", the switching element SW3 becomes on and the potential on the line 2 is applied onto the row electrode drive line 3 via the diode D5. That is, the potential on the line 2 directly becomes the signal level of the row electrode Y drive signal.

When the logic level of the SW9 control signal is "1" then, the switching element SW9 in the sustain pulse generator 102 becomes on, so that the potential on the line 2 becomes "0" (V) and the signal level of the row electrode Y drive signal becomes "0" (V) too. When the logic level of the SW7 control signal becomes "1" then, the switching element SW7 in the sustain pulse generator 102 becomes on. At this time, the potential on the line 2 gradually rises due to the actions of the capacitor C1 and the coil L1 of the sustain pulse generator 102. When the logic level of the SW6 control signal becomes "1" then, the switching element SW6 in the sustain pulse generator 102 becomes on, so that the potential on the line 2 becomes equal to the level of the supply voltage $V_3$ of the third voltage supply B3. When the logic level of the SW8 control signal becomes "1" then, the switching element SW8 in the sustain pulse generator 102 becomes on. At this time, the potential on the line 2 gradually drops due to the actions of the capacitor C1 and the coil L2 of the sustain pulse generator 102. The sequence of actions of the switching elements SW6 to SW9 causes the sustain pulse $IR_y$ as shown in FIG. 7L to appear on the row electrode Y drive signal.

In the embodiment as shown in FIG. 6, as apparent from the above, at the time the priming pulse and scan pulse are generated (by the scan pulse generator 104) by alternately applying the potentials of the positive terminal and the negative terminal of the first voltage supply B1 to the row electrodes, the potentials of the positive terminal of the second voltage supply B2*a*, which generates a smaller DC voltage than the first voltage supply B1 and has its negative terminal grounded, is applied to the positive terminal of the first voltage supply B1 to shift the potentials of the negative terminal of the first voltage supply B1 to the negative side (voltage-supply potential shifter).

According to this invention, therefore, even if the above-described scan pulse generator is constructed by using a general-purpose IC which can perform scanning only with a pulse of a single polarity, the priming pulse and scan pulse which have different polarities can be generated. This can ensure stable image display with a low-cost structure.

What is claimed is:

1. A plasma display apparatus comprising:

a plasma display panel having a plurality of row electrodes and a plurality of column electrodes laid out to intersect said row electrodes; and a row electrode driving device for applying a priming pulse to said row electrodes to temporarily discharge discharge cells formed at intersections of said row electrodes and said column electrodes, and then applying a scan pulse to said row electrodes to thereby write pixel data, said row electrode driving device including, a first voltage supply for generating a DC voltage, a scan pulse generator for alternately applying a potential of a positive terminal of said first voltage supply and a potential of a negative terminal thereof to said row electrodes to generate said priming pulse and said scan pulse, and a voltage-supply potential shifter which includes a second voltage supply with a grounded negative terminal, said second voltage supply generating a DC voltage lower than a voltagc of said first voltage supply, for applying a potential of a positive terminal of said second voltage supply to said positive terminal of said first voltage supply, thereby shifting said potential of said negative terminal of said first voltage supply, wherein said row electrode driving device further includes a reset pulse generator for simultaneously applying a reset pulse to all of said row electrodes before generation of said priming pulse and said scan pulse, thereby uniformly forming wall charges in all of said discharge cells, said reset pulse generator having switching means for temporarily grounding said row electrodes to make said row electrodes in a floating state after application of said reset pulse to said row electrodes.

2. The plasma display apparatus according to claim 1, wherein said voltage-supply potential shifter applies said potential of said positive terminal of said second voltage supply to said positive terminal of said first voltage supply after application of said reset pulse.

3. The plasma display apparatus according to claim 1, wherein said voltage-supply potential shifter has a DC voltage supply having a positive terminal connected to said positive terminal of said second voltage supply, and alternately applies said potential of said positive terminal of said second voltage supply and a potential of a negative terminal of said DC voltage supply to said positive terminal of said first voltage supply after application of said reset pulse.

4. The plasma display apparatus according to claim 1, wherein while said voltage-supply potential shifter is applying said potential of said negative terminal of said DC voltage supply to said positive terminal of said first voltage supply, said scan pulse generator applies said potential of said negative terminal of said first voltage supply to said row electrodes to thereby generate said scan pulse.

5. The plasma display apparatus according to claim 3, wherein while said voltage-supply potential shifter is applying said potential of said negative terminal of said DC voltage supply to said positive terminal of said first voltage supply, said scan pulse generator applies said potential of said negative terminal of said first voltage supply to said row electrodes to thereby generate said scan pulse.

6. A plasma display apparatus comprising:

a plasma display panel having a plurality of row electrodes and a plurality of column electrodes laid out to intersect said row electrodes; and a row electrode driving device for applying a priming pulse to said row electrodes to temporarily discharge discharge cells formed at intersections of said row electrodes and said column electrodes, and then applying a scan pulse to said row electrodes to thereby write pixel data, said row electrode driving device including a reset pulse generator for simultaneously applying a reset pulse to all of said row electrodes before generation of said priming pulse and said scan pulse, thereby uniformly forming wall charges in all of said discharge cells, said reset pulse generator having switching means for temporarily grounding said row electrodes to make said row electrodes in a floating state after application of said reset pulse.

* * * * *